US008651345B2

(12) United States Patent
Esten

(10) Patent No.: US 8,651,345 B2
(45) Date of Patent: Feb. 18, 2014

(54) GLOVE WITH STATIONARY ARRANGEMENT

(76) Inventor: Noel K. Esten, El Segundo, CA (US)

( * ) Notice: Subject to any disclaimer, the term of this patent is extended or adjusted under 35 U.S.C. 154(b) by 1200 days.

(21) Appl. No.: 12/291,098

(22) Filed: Nov. 5, 2008

(65) Prior Publication Data

US 2010/0107303 A1 May 6, 2010

(51) Int. Cl.
*A47G 25/80* (2006.01)

(52) U.S. Cl.
USPC ..... 223/111; 224/183

(58) Field of Classification Search
USPC ..... 224/183; 2/160, 162, 167; 223/111; 248/683, 206.5; 24/303
See application file for complete search history.

(56) References Cited

U.S. PATENT DOCUMENTS

| | | | | | |
|---|---|---|---|---|---|
| 2,915,173 | A * | 12/1959 | Langdon | ..... | 206/295 |
| 3,517,806 | A * | 6/1970 | Wittland | ..... | 206/295 |
| 6,427,883 | B1 * | 8/2002 | Esten | ..... | 223/111 |
| 7,051,374 | B1 * | 5/2006 | Grilliot et al. | ..... | 2/69 |
| 7,146,651 | B1 * | 12/2006 | Lapin | ..... | 2/338 |
| 2007/0150996 | A1 * | 7/2007 | McCarville | ..... | 2/159 |
| 2011/0138517 | A1 * | 6/2011 | Ambrosio et al. | ..... | 2/160 |

* cited by examiner

*Primary Examiner* — Justin Larson
*Assistant Examiner* — Corey Skurdal
(74) *Attorney, Agent, or Firm* — Raymond Y. Chan; David and Raymond Patent Firm

(57) ABSTRACT

A glove with stationary arrangement includes at least a glove body having a non-operatable area, a glove station having a retention surface, and a magnetic arrangement provided at the non-operatable area of the glove body in a hidden manner, wherein the magnetic arrangement is magnetically affixed at the retention surface to detachably retain the glove body thereon so as to enable the user wearing the glove body in a donning and doffing manner in a hand down position.

7 Claims, 6 Drawing Sheets

GLOVE WITH STATIONARY ARRANGEMENT

BACKGROUND OF THE PRESENT INVENTION

1. Field of Invention

The present invention relates to gloves, and more particularly to a glove with stationary arrangement, wherein the personal glove is adapted to detachably couple with a glove stationary so as to enable the user easily wearing the glove body in a donning and doffing manner.

2. Description of Related Arts

Gloves are used for not only keeping our hands warm but also protecting our hands so as to provide a sanitary condition of our hands. For example, in chemical industries, people wear gloves for preventing chemical element from contacting with their hands. It is extremely important that since some chemical elements are hazardous, which may cause skin disease or even cancer. So, when people deal with the chemical elements, they must wear gloves for protection.

However, such people may still have a chance to skin contact with the chemical element while they remove the gloves from their hands and wear the used gloves back to their hands. For example, it is not hassle that when a wearer removes his left glove from his left hand since his right hand still has a right glove thereon. However, after removing the left glove, his bare left hand must contact with the right glove in order to remove the right glove from his right hand in such a manner that his right hand may merely contact with the chemical element strained on left glove. Even though the right and left gloves are cleaned by water or other solvents before removing the gloves, the chemical element cannot be totally washed by water.

Moreover, when wearing the gloves, the wearer must use his bare hands to hold the gloves such that the wearer may merely touch the gloves with his bare hand in such a manner that the wearer's hand will contact the residual chemical element on the gloves.

In view of above, a glove stand is adapted for holding the gloves in position such that the glove stand can help the wearer to wear and remove the gloves in order to minimize the skin contact with the gloves. Even though there is some glove stands being sold on the markets, most of them contain the following drawbacks. First, the floor stand is usually large and heavy. It is a hassle for people to always move such a big floor stand with them. Second, the attaching loop is affixed to an edge of the glove such that the wearer may have difficulty to remove the glove. Thus, the wearer also has difficulty to wear the glove in such a suspending position. So, the wearer may merely use his hand to wear and remove the glove as well. Finally, the application of such floor stand is really limited such that it can only be used in particular places. People prefer to have a particular glove stationary which is easy to always carry on with them and is capable of using in different situation.

It is necessary to develop a personal glove stationary which can overcome these disadvantages and put people's preference into reality.

SUMMARY OF THE PRESENT INVENTION

A main object of the present invention is to provide a glove with stationary arrangement, wherein the glove body is adapted to detachably couple with a glove station so as to enable the user easily wearing the glove body in a donning and doffing manner.

Another object of the present invention is to provide a glove with stationary arrangement, wherein the glove station is selectively located at any desired location according to the user's preference to retain the glove in position. In other words, the user is able to locate the glove station at any desired location for retaining the glove conveniently.

Another object of the present invention is to provide a glove with stationary arrangement, wherein a magnetic arrangement is provided to magnetically couple the glove body with the glove station so as to provide a quick and easy attachment for the user wearing the glove body in a donning and doffing manner.

Another object of the present invention is to provide a glove with stationary arrangement, wherein the user is able to use one hand to don and doff the glove body without contacting with the outer surface of the glove body so as to prevent the contamination of the hands of the user by touching the outer surface of the glove body during donning and doffing operation.

Another object of the present invention is to provide a glove with stationary arrangement, wherein the user is able to easily don and doff the glove in a hand down position. Accordingly, the magnetic arrangement is provided at the lower half portion of the glove body such that when the glove body is magnetically attached to the glove station, the glove body is naturally secured thereon an inclined manner by its own weight for the user to don and doff easily.

Another object of the present invention is to provide a glove with stationary arrangement, wherein the magnet element is affixed to the glove body in a hidden manner such that the user is able to don and doff the glove with good flexibility but without changing its original appearance.

Another object of the present invention is to provide a glove with stationary arrangement, wherein the glove body has practical applications in many different kinds of usages, such as automotive repair, industrial operation, cooking process, experimental operation and so on and is capability of matching with personal dress such as belts, and pants for protecting a wearer from skin contacting with an exterior surface of the glove.

Another object of the present invention is to provide a glove with stationary arrangement, wherein the glove station is combined with daily use belts and glove station together to provide a personal glove stationary for special glove for preventing the wearer's skin from contacting with an exterior surface of the glove. Thus, the user only needs to wear the belt, but doesn't need to bring extra equipment for securely placing their gloves.

Another object of the present invention is to provide a glove with stationary arrangement, wherein the personal glove stationary is fully utilized just adjusting the regular pants' structure, but achieve the goal of no need to bring extra equipment for securely placing their gloves.

Another object of the present invention is to provide a glove with stationary arrangement, wherein the glove body is supported on the glove station in a hand down position, which is facilitated for a wearer to wear and remove the glove.

Another object of the present invention is to provide a glove with stationary arrangement, wherein in the donning and doffing operations, the glove station can hold the glove body in position, so as to prevent the wearer's skin from contacting with an exterior surface of the glove.

Accordingly, in order to accomplish the above objects, the present invention provides a glove with stationary arrangement, comprising:

at least a glove body having a non-operatable area;

a glove station having a retention surface; and a magnetic arrangement provided at the non-operatable area of the glove body in a hidden manner, wherein the magnetic arrangement is magnetically affixed at the retention surface to detachably retain the glove body thereon so as to enable the user wearing the glove body in a donning and doffing manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
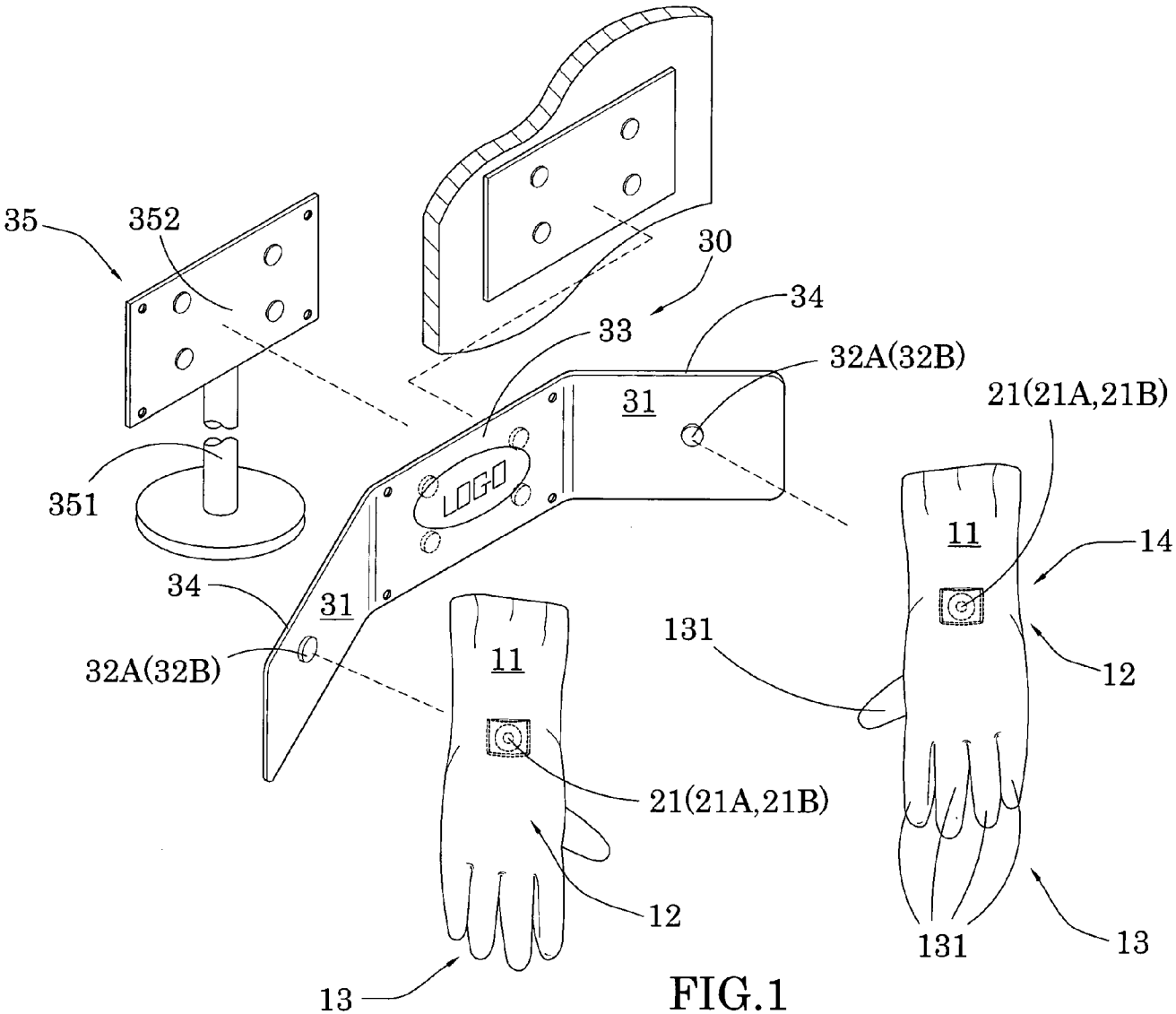
FIG. 1 is a perspective view of a glove with stationary arrangement according to a preferred embodiment of the present invention, illustrating the retention surface and its alternatives.

Referring to FIG. 1 of the drawing, a glove with stationary arrangement according to a preferred embodiment of the present invention is illustrated, wherein the glove with stationary arrangement comprises at least a glove body 10 having a non-operatable area, a glove station 30 having a retention surface 31, and means for detachably retaining the glove body 10 on the retention surface 31.

The retaining means comprises a magnetic arrangement 20 provided at the non-operatable area of the glove body 10 in a hidden manner, wherein the magnetic arrangement is magnetically affixed at the retention surface 31 to detachably retain the glove body 10 thereon so as to enable the user wearing the glove body 10 in a donning and doffing manner.

According to the preferred embodiment, the glove body 10, which is adapted for being worn by a hand of a user, has a dorsal side 11, a palm portion 12, and a finger portion 13. As shown in FIG. 1, the finger portion 13 of the glove body 10 has five finger pockets 131 receiving fingers of the user thereat respectively. Alternatively, the finger portion 13 of the glove body 10 can have one finger pocket and one thumb pocket as a kitchen glove.

The glove body 10 is preferably the specific kind used in chemical industries, which is made of durable material for protecting a wearer from direct skin contacting with chemicals. An exterior surface of the glove body 10 has an operatable area and the non-operatable area, wherein the operatable area of the glove body 10 is defined as the finger portion 13 and the palm side of a hand portion of the glove body 10. The non-operatable area of the glove body 10 is defined by a non-working area of the glove body 10 such as an outer side of the hand portion and a wrist portion 14 of the glove body 10. In other words, an object is held or grasped within the operatable area of the glove body 10 and the rest of the glove body 10 is the non-operatable area, such that the non-operatable area of the glove body 10 provides no hand operation when the glove body 10 is worn.

Figure 2:
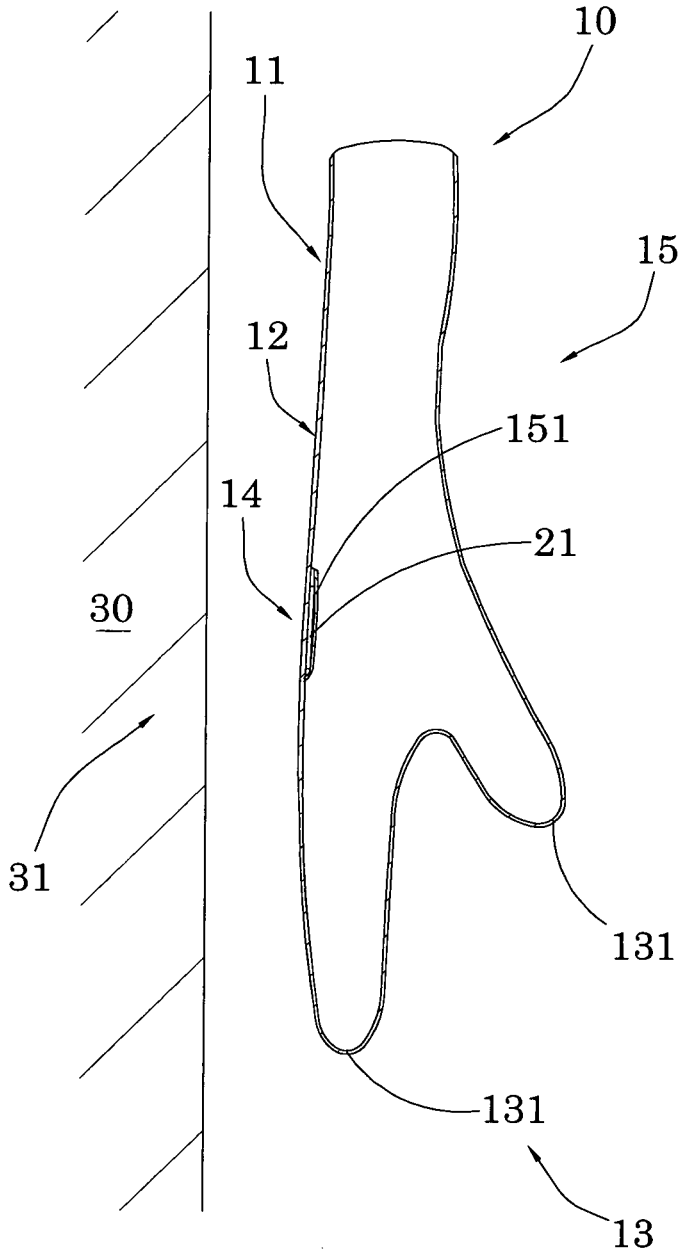
FIG. 2 is a sectional view of the glove body according to the above preferred embodiment of the present invention.

As shown in FIGS. 1 and 2, the magnetic arrangement 20 comprises a magnetic element 21 coupled at the dorsal side 11 of the glove body 10 at the wrist portion 14 thereof as the non-operatable area to provide a quick and ease of magnetically attachment between the glove body 10 and the retention surface 31 of the glove station 30. Accordingly, the glove body 10 can be magnetically attached to the retention surface 31 of the glove station 30 via the magnetic element 21, wherein the retention surface 31 of the glove station 30 has a portion made of magnetically attracting material such as metal. Therefore, when the user place his or her close to the retention surface 31, the magnetic element 21 will automatically attract to the retention surface 31. Once the magnetic element 21 is magnetically coupled on the retention surface 31, the user is able to doff the glove body 10 while the glove body 10 is securely retained on the retention surface 31. It is worth to mention that the user is able to mount a metal panel on a wall surface to form the retention surface 31 while the metal panel can be selectively adjusted its position on the wall surface to fit the hand position of the user.

Accordingly, the magnetic element 21, having a predetermined weight, is a magnet provided at the lower half (at the wrist portion 14) of the glove body 10, the center mass of the glove body 10 will be shifted at the lower half thereof. In particularly, the magnetic element 21 not only applies a downward weight force at the glove body 10 for naturally maintaining the glove body 10 in an inclined manner when the glove body 10 is affixed at the retention surface 31, but also enhances the glove body 10 being worn by the user in a donning and doffing manner.

It is important that when the user wears the glove body 10 and contacts with a liquid chemical substance, the chemical substance will stay on the glove body 10. When the glove body 10 is retained on the retention surface 31, the chemical substance will naturally drip down towards the finger portion 13 so as to prevent the user from contacting with the outer surface of the glove body 10 during don and doff operation. In addition, the user is able to easily don and doff the glove body 10 in a hand down position when the glove body 10 is inclinedly retained on the retention surface 31.

In order to retain the magnetic arrangement 20 in position, the glove body 10 comprises a receiving pocket 15 provided at the dorsal side 11 of the glove body 10 to replaceably receive the magnetic arrangement 20 so as to retain the magnetic arrangement 20 in position. As shown in FIGS. 1 and 2, the receiving pocket 15 has a top opening and a receiving cavity for replaceably receiving the magnetic element 21 therein. In particularly, the receiving pocket 15 comprises a pocket layer 151 affixed to the inner surface of the glove body 10 at the wrist portion 14 to define the receiving cavity between the pocket layer 151 and the inner surface of the glove body 10 so as to enable the magnetic arrangement 20 being received in the receiving pocket 15 through the top opening. It is appreciated that the pocket layer 151 can be provided on the outer side of the glove body 10 to form the receiving pocket 15 at the outer surface of the glove body 10 to retain the magnetic element 21 thereat.

Accordingly, the magnetic element 21 of the magnetic arrangement 20 is replaceable to selectively dispose in the receiving pocket 15 such that the user is able to remove or change the magnetic element 21 corresponding to individual need.

According to the preferred embodiment, the glove body 10 is used in many different kinds of usages, such as automotive repair, industrial operation, cooking process, experimental operation and so on and is capability of matching with personal dress such as belts, and pants for protecting a wearer from skin contacting with an exterior surface of the glove. For example, the automotive repair glove is used for repair shops, paint and body work. The cooking process glove includes cooking with food in the restaurants, kitchens, and hotels. The industrial operation gloves are mainly used for chemical material handing such as solvents and solutions mixing and separation.

It is worth to mention that the glove body 10 is mounted on the retention surface 31 or anywhere metal surface. In such a hand down position that the wearer's hand is in naturally bending down manner, the hand of the user is adapted for easily donning and doffing the glove body 10 when the glove body 10 is retained on the retention surface 31 without skin contacting with the exterior surface of the glove body 10.

For doffing the glove body 10, the wearer naturally bends down his or her hand and slides his or her hand into the glove body 10 from an inserting angle. Once the dorsal side 11 of the glove body 10 is positioned close to the retention surface 31, the magnetic element 21 will magnetically attract to the retention surface 31. At the time when the magnetic element 21 is magnetically coupled on the retention surface 31, the hand of the user is able to detach from the glove body 10 without skin-contacting with the outer surface of the glove body 10. It is worth to mention that after the user doffs the glove body 10, the glove body 10 will remain at the same orientation on the retention surface 31.

For donning the glove body 10, the hand of the user is naturally placed at a hand down position that the user is able to naturally put his or her hand into the glove body. Since the glove body 10 is retained on the retention surface 31 via the magnetic element 21, the user is able to easily locate his or her fingers to align with the finger pockets 131 of the glove body 10. After the glove body 10 is worn, the user is able to apply a pulling force to magnetically repel the magnetic force between the magnetic element 21 and the retention surface 31.

So, the entire donning and doffing process of the glove body 10, the user does not need to touch the exterior surface of the glove body 10 so as to prevent the user from being infected by any chemical element strained on the glove body 10. To sum up, the glove body 10 not only better protects our health by helping to eliminate contaminant inside the glove body 10, but also allows the user to don and doff the glove body without using the opposing hand anywhere there is metal to which the magnet can attach.

It is worth to mention that the glove body 10 is made of waterproof material and chemical resistance material for keeping the working hands from being damaging by constant use. On the other hand, the material of the glove body 10 is light but durable so as to maximum the life span of the personal glove use.

In order to magnetically couple the glove body 10 at the retention surface 31, the magnetic element 21A can be made of magnetically attracting material, such as metal, provided at the lower half (at the wrist portion 14) of the glove body 10. The magnetic element 21A is replaceably disposed in the receiving pocket 15 to retain the magnetic arrangement 20A in position. Accordingly, the glove station 30 further comprises a magnet 32A provided on the retention surface 31 to magnetically attract the magnetic element 21A so as to detachably retain the glove body 10 at the retention surface 31 of the glove station 30, as shown in FIG. 1.

Likewise, the magnetic element 21B can be a magnet provided at the lower half (at the wrist portion 14) of the glove body 10. The magnetic element 21B is replaceably disposed in the receiving pocket 15 to retain the magnetic element 21B in position. Accordingly, the glove station 30 further comprises a magnet 32B provided on the retention surface 31 to magnetically attract the magnetic element 21B so as to detachably retain the glove body 10 at the retention surface 31 of the glove station 30, as shown in FIG. 1. It is worth to mention that the magnetic element 21B and the magnet 32B are two magnets with two opposite poles. In the words, the pole of the face of the magnetic element 21B is different from the pole of the face of the magnetic 32B. Having the two-magnet configuration, the glove body 10 can further securely retain on the retention surface 31.

Figure 3:
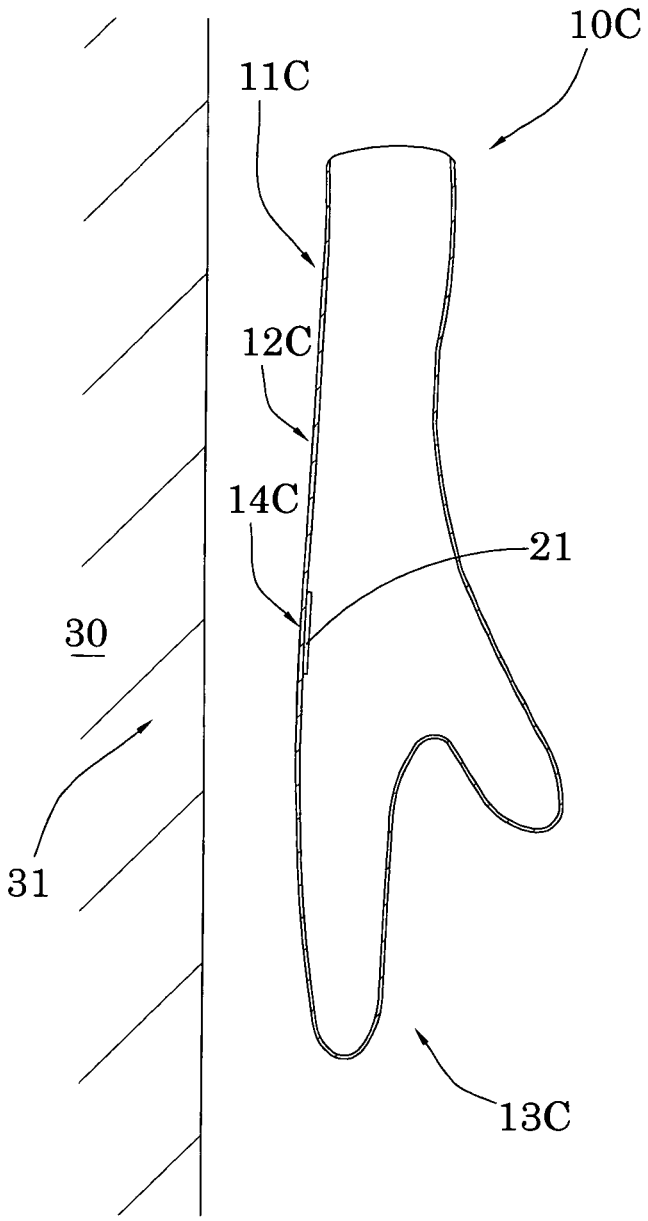
FIG. 3 illustrates an alternative mode of the glove body according to the above preferred embodiment of the present invention.

FIG. 3 illustrates an alternative mode of the glove body 10C, wherein the glove body 10C has a dorsal side 11C, a palm portion 12C, and a finger portion 13C. The magnetic element 21, 21A, 21B is affixed to the inner side of the glove body 10C such that the user is able to don and doff the glove body 10C with good flexibility without changing its original appearance. Accordingly, the magnetic element 21, 21A, 21B, having a predetermined weight, is provided at the lower half (at the wrist portion 14C) of the glove body 10C at the dorsal side 11C thereof. In other words, the magnetic element 21, 21A, 21B is permanently affixed at the inner side of the glove body 10C. It is worth to mention that the magnetic element 21, 21A, 21B can be selectively incorporated with the glove body 10C to meet the preference of the user.

As shown in FIG. 1, the glove station 30 further comprises a center panel 33 adapted for affixing to a surface, and two side panels 34 sidewardly and inclinedly extended from two side edges of the center panel 33 respectively, wherein the retention surface 31 is formed at each of the side panels 34 to detachably couple the glove body 10 at the respective side panel 34.

It is appreciated that the side panels 34 can be made of magnetically attracting material, such as metal, to form the retention surface 31 such that the magnetic element 21 is magnetically coupled with the side panel 34 so as to detachably retain the glove body 10 at the retention surface 31. Alternatively, the magnet 32A, 32B can be affixed to each of the side panels 34 to form the retention surface 31 thereat such that the magnetic element 21A, 21B is magnetically coupled with the side panel 34 so as to detachably retain the glove body 10 at the retention surface 31, as shown in FIG. 1.

Preferably, two glove bodies 10 can be magnetically retained at the retention surfaces 31 at the side panels 34 respectively, wherein the user is able to don and doff the glove body 10 at the side panels 34 without using the opposing hand.

Accordingly, the glove station 30 further comprises a glove stand 35 to support the side panels 34 at a predetermined elevated position, as shown in FIG. 1. The glove stand 35 comprises a ground base 351 and a panel supporter 352 upwardly extended from the ground base 351 at an elevated position corresponding to the hand down position of the user. The center panel 33 is affixed to the panel supporter 352 of the glove stand 35 to support the side panels 33 at the elevated position for the user to don and doff the glove body 10 at the hand down position. It is worth to mention that the center panel 33 can be directly mounted on the wall surface that the user is able to selectively adjust the elevated position of the side panels 34 corresponding to the hand down position of the user.

Figure 4:
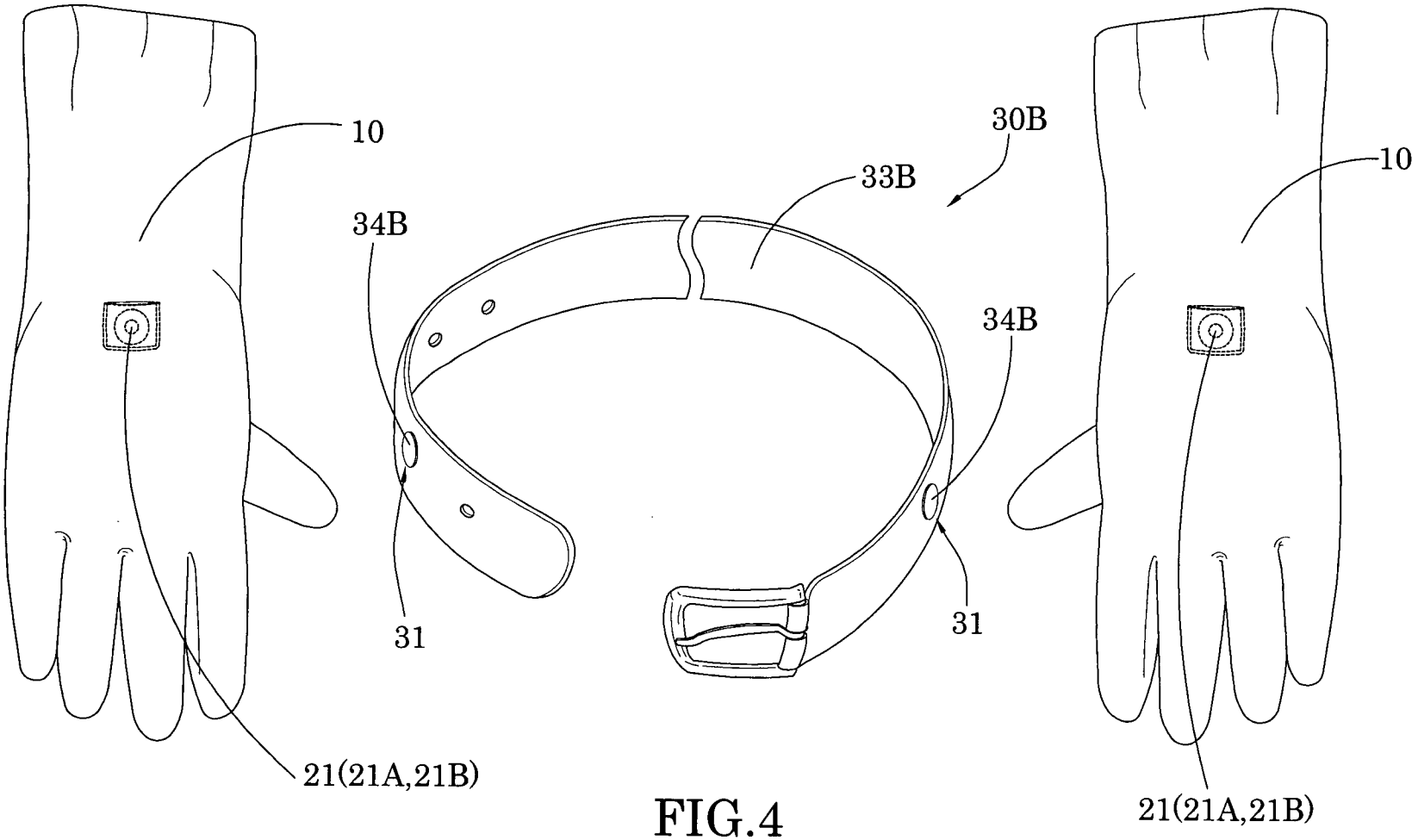
FIG. 4 illustrates a first alternative mode of the glove station according to the above preferred embodiment of the present invention.

FIG. 4 illustrates an alternative mode of the glove station 30B, wherein the glove station 30B further comprises a waist belt 33B adapted for being worn a waist of the user, and at least a magnetic holder 34B provided at the waist belt 33B to form the retention surface 31 at the magnetic holder 34B so as to detachably retain the glove body 10 at said waist belt 33B. Accordingly, the magnetic holder 34B can be made of magnetically attracting material, such as metal, to form the retention surface 31 such that the magnetic element 21 is magnetically coupled with the magnetic holder 34B so as to detachably retain the glove body 10 at the retention surface 31. Alternatively, the magnetic holder 34B can be made of the magnet to affix to the waist belt 33B to form the retention surface 31 thereat such that the magnetic element 21A, 21B is magnetically coupled with the magnetic holder 34B so as to detachably retain the glove body 10 at the retention surface 31 at the waist belt 33B.

Figure 5:
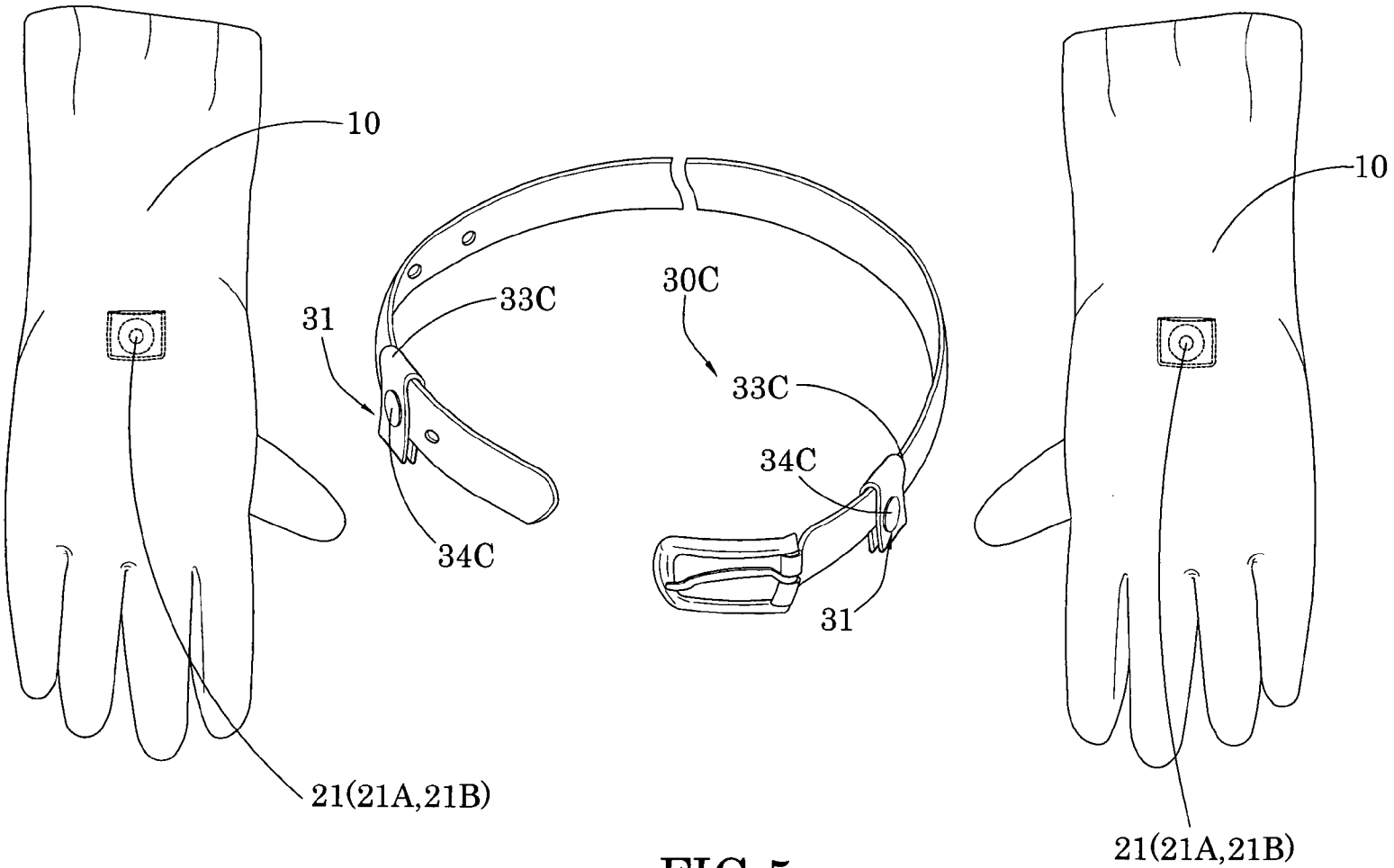
FIG. 5 illustrates a second alternative mode of the glove station according to the above preferred embodiment of the present invention.

FIG. 5 illustrates another alternative mode of the glove station 30C, wherein the glove station 30C further comprises a belt clipper 33C adapted for detachably affixing at a waist belt, and at least a magnetic holder 34C provided at the belt clipper 33C to form the retention surface 31 at the magnetic holder 34C for detachably retaining the glove body at the waist belt. The belt clipper 33C can be selectively adjusted its position along the waist belt corresponding to the hand down position of the user.

Accordingly, the magnetic holder 34C can be made of magnetically attracting material, such as metal, to form the retention surface 31 such that the magnetic element 21 is magnetically coupled with the magnetic holder 34C so as to detachably retain the glove body 10 at the retention surface 31. Alternatively, the magnetic holder 34C can be made of the magnet to form the retention surface 31 thereat such that the magnetic element 21A, 21B is magnetically coupled with the magnetic holder 34C so as to detachably retain the glove body 10 at the retention surface 31 at the waist belt.

Figure 6:
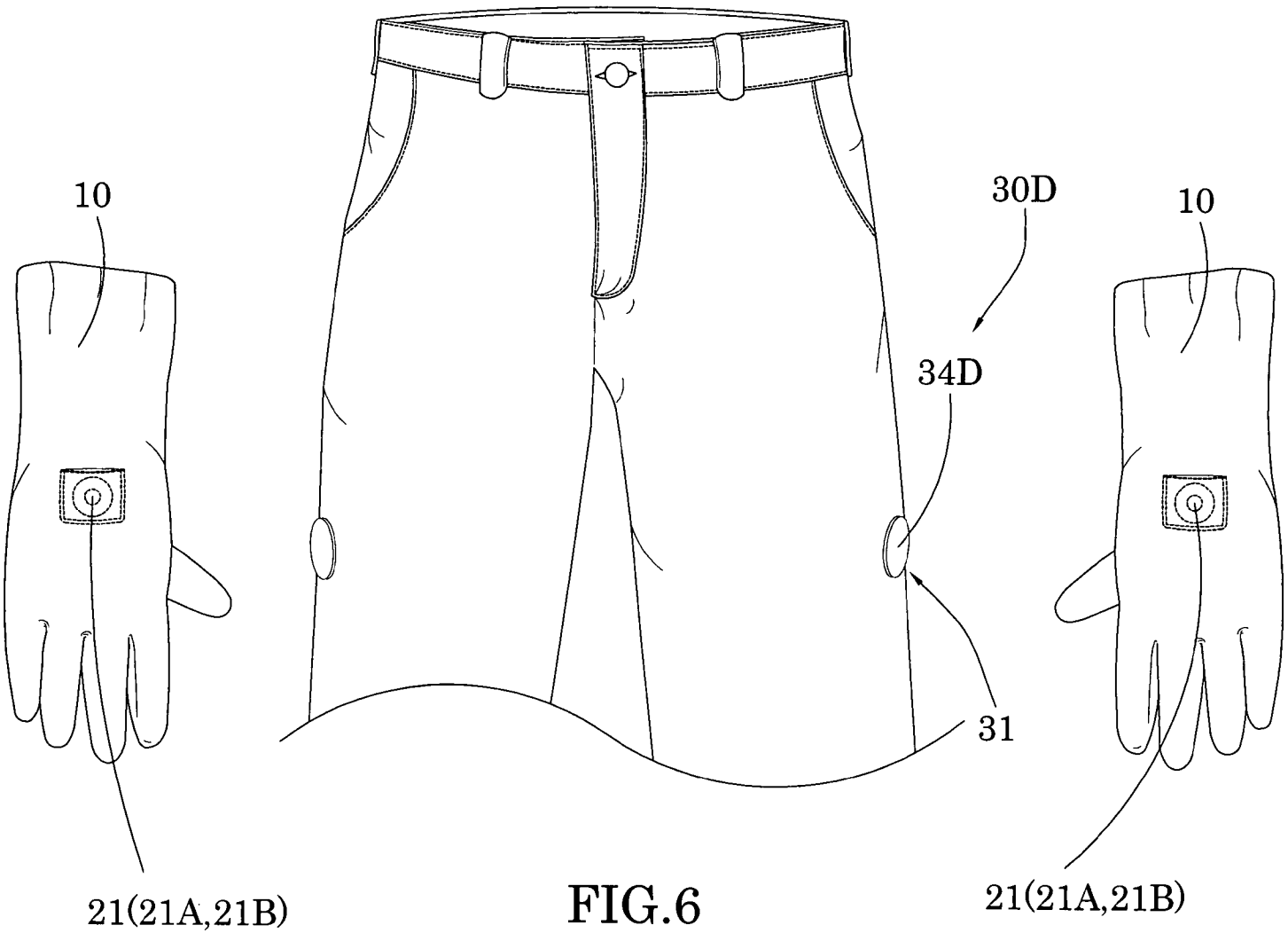
FIG. 6 illustrates a third alternative mode of the glove station according to the above preferred embodiment of the present invention.

FIG. 6 illustrates another alternative mode of the glove station 30D, wherein the glove station 30D further comprises a magnetic holder 34D adapted for selectively affixing to a pant worn by the user with respect to a hand position of said user, wherein the retention surface 31 is formed at the magnetic holder 34D for detachably retaining the glove body 10 at the pant. Accordingly, the magnetic holder 34D can be made of magnetically attracting material, such as metal, to form the retention surface 31 such that the magnetic element 21 is magnetically coupled with the magnetic holder 34C so as to detachably retain the glove body 10 at the retention surface 31. Alternatively, the magnetic holder 34D can be made of the magnet to form the retention surface 31 thereat such that the magnetic element 21A, 21B is magnetically coupled with the magnetic holder 34D so as to detachably retain the glove body 10 at the retention surface 31 at the waist belt.

In view of above, the glove with stationary arrangement of the present invention can substantially provide the following advantages in comparison with the conventional glove stand:

(1) The chemical work gloves, metal work gloves, auto mechanic gloves, and gardening gloves are all suitable to employ the glove with stationary arrangement of the present invention. It enhances the donning and doffing operation of the glove body 10. Since the glove bodies 10 are supported on the glove station 30 in the hand-down position that the user's hands are in naturally bending manner, the user is able to wear and remove the gloves easily without skin contacting with the exterior of the glove bodies 10 so as to prevent the user's hands be polluted by the chemicals, stains, grease, or dirt on the gloves.

(2) When the glove bodies 10 are attached on the glove station in the hand-down position, due to the gravity, the chemicals, stains, grease, or dirt on the glove bodies 10 will automatically drop down therefrom. Thus, the operating area of the glove bodies 10 is entirely exposed to the surroundings so as to speed up the drying process of the glove bodies 10.

The glove station 30 is adapted for incorporating with any conventional glove wherein simply provides a magnetic arrangement 20 on the conventional glove will achieve the same function as mentioned above. So, any kind of gloves, such as sports gloves, can be used without altering the original structure so as to minimize the manufacturing cost of the gloves incorporating with the glove station 30.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A glove with stationary arrangement, comprising:

at least a glove body having a non-operatable area, wherein said glove body is adapted for being worn by a hand of a user that said non-operatable area of said glove body provides no hand operation when said glove body is worn;

a glove station having a retention surface; and a magnetic arrangement for detachably retaining said glove body on said retention surface and for enabling said user wearing said glove body in a donning and doffing manner, wherein said magnetic arrangement comprises a magnetic attracting element provided at said non-operatable area of said glove body at an inner side thereof so as to hold said magnetic attracting element in a hidden manner, and a magnet magnetically mounted at said retention surface of said glove station, wherein said magnetic attracting element is magnetically attracted to said magnet to detachably retain said glove body on said retention surface of said glove station, wherein said magnetic attracting element not only applies a downward weight force at said glove body for naturally maintaining said glove body in an inclined manner when said glove body is affixed at said retention surface, but also enhances said glove body being worn by said user in a donning and doffing manner at a hand-down position.

2. The glove with stationary arrangement, as recited in claim 1, wherein said magnetic attracting element is made of magnetically attracting material and is not a magnet.

3. The glove with stationary arrangement, as recited in claim 1, wherein said glove body comprises a receiving pocket provided at said inner side of said glove body to replaceably receive said magnetic attracting element in said receiving pocket.

4. The glove with stationary arrangement, as recited in claim 2, wherein said glove body comprises a receiving pocket provided at said inner side of said glove body to replaceably receive said magnetic attracting element in said receiving pocket.

5. The glove with stationary arrangement, as recited in claim 1 wherein said glove station comprises a center panel adapted for affixing to a surface, and two side panels sidewardly and inclinedly extended from two side edges of said center panel respectively, wherein said retention surface is formed at each of said side panels to detachably couple said glove body at said respective side panel.

6. The glove with stationary arrangement, as recited in claim 2 wherein said glove station comprises a center panel adapted for affixing to a surface, and two side panels sidewardly and inclinedly extended from two side edges of said center panel respectively, wherein said retention surface is formed at each of said side panels to detachably couple said glove body at said respective side panel.

7. The glove with stationary arrangement, as recited in claim 4 wherein said glove station comprises a center panel adapted for affixing to a surface, and two side panels sidewardly and inclinedly extended from two side edges of said center panel respectively, wherein said retention surface is formed at each of said side panels to detachably couple said glove body at said respective side panel.

* * * * *